US009810380B2

(12) United States Patent
Deng et al.

(10) Patent No.: US 9,810,380 B2
(45) Date of Patent: Nov. 7, 2017

(54) OUTDOOR LUMINAIRE

(71) Applicant: PHILIPS LIGHTING HOLDING B.V., Eindhoven (NL)

(72) Inventors: Shitao Deng, Shanghai (CN); Xiaoyan Zhu, Shanghai (CN); Ingrid Emilienne Joanna Rita Heynderickx, Geldrop (NL); Ans Van Den Broek-Cools, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 102 days.

(21) Appl. No.: 14/367,953

(22) PCT Filed: Dec. 10, 2012

(86) PCT No.: PCT/IB2012/057118

§ 371 (c)(1),
(2) Date: Jun. 23, 2014

(87) PCT Pub. No.: WO2013/093698

PCT Pub. Date: Jun. 27, 2013

(65) Prior Publication Data

US 2014/0347856 A1 Nov. 27, 2014

(30) Foreign Application Priority Data

Dec. 23, 2011 (WO) ..... PCT/CN2011/084584

(51) Int. Cl.
*F21V 11/06* (2006.01)
*F21K 99/00* (2016.01)
(Continued)

(52) U.S. Cl.
CPC ..... *F21K 9/30* (2013.01); *F21K 9/20* (2016.08); *F21K 9/60* (2016.08); *F21S 8/086* (2013.01);
(Continued)

(58) Field of Classification Search
CPC ... F21S 8/085–8/088; F21K 9/30; F21K 9/50; F21K 9/58
See application file for complete search history.

(56) References Cited

U.S. PATENT DOCUMENTS 6,929,382 B2 8/2005 Kuisma
2009/0237930 A1 9/2009 Li
(Continued)

FOREIGN PATENT DOCUMENTS

CN 1425869 A 6/2003
CN 2924283 Y 7/2007
(Continued)

*Primary Examiner* — Mariceli Santiago

(57) ABSTRACT

The invention discloses an outdoor luminaire. The outdoor luminaire comprises a light module comprising at least one LED unit; wherein said light module is configured such that the light emitted by the light module has a first luminous intensity value no less than 10 cd/klm at a first angle (γi), which is a vertical angle of 90 degrees above a direction pointing directly downward from the luminaire. In this way, the luminous intensity of the outdoor luminaire at a vertical angle of 90 degrees is guaranteed to be no less than 10 cd/klm Since the end user sees the light emitted at a vertical angle of 90 degrees no matter how far away he is from the outdoor luminaire, the end user always perceives a certain level of brightness. Such "certain level of brightness" is helpful in increasing the adaptation level of the end user, and can effectively reduce the end user's perception of glare.

9 Claims, 4 Drawing Sheets

(51) Int. Cl.

| | |
|---|---|
| ***F21S 8/08*** | (2006.01) |
| ***F21K 9/20*** | (2016.01) |
| ***F21K 9/60*** | (2016.01) |
| *F21W 131/10* | (2006.01) |
| *F21Y 115/10* | (2016.01) |

(52) U.S. Cl.
CPC ..... *F21V 11/06* (2013.01); *F21W 2131/10* (2013.01); *F21Y 2115/10* (2016.08)

(56) References Cited

U.S. PATENT DOCUMENTS

| | | | | |
|---|---|---|---|---|
| 2009/0284966 | A1* | 11/2009 | Crookham ..... | F21S 8/033 362/231 |
| 2009/0303715 | A1* | 12/2009 | Takasago ..... | F21S 8/086 362/235 |
| 2010/0277906 | A1 | 11/2010 | Choi | |
| 2010/0321930 | A1* | 12/2010 | Watanabe ..... | F21S 8/086 362/184 |

FOREIGN PATENT DOCUMENTS

| | | | |
|---|---|---|---|
| CN | 101230962 | A | 7/2008 |
| CN | 201462619 | U | 5/2010 |
| CN | 201636715 | U | 11/2010 |
| CN | 20202411 | U | 11/2011 |
| DE | 202009010328 | U1 | 11/2009 |
| JP | 11-134905 | A | 5/1999 |
| JP | 2005251724 | A | 9/2005 |
| JP | 2009245621 | A | 10/2009 |
| WO | 2008125772 | A1 | 10/2008 |

* cited by examiner

OUTDOOR LUMINAIRE

CROSS-REFERENCE TO PRIOR APPLICATIONS

This application is the U.S. National Phase application under 35 U.S.C. §371 of International Application No. PCT/IB2012/057118, filed on Dec. 10, 2012, which claims the benefit of Chinese Patent Application No. PCT/CN2011/084584, filed on Dec. 23, 2011. These applications are hereby incorporated by reference herein.

FIELD OF THE INVENTION

The present invention relates to lighting, particularly to an outdoor LED luminaire.

BACKGROUND OF THE INVENTION

For outdoor luminaires, it is important to solve the problem of glare, because glare causes many road safety problems. Currently, the glare effect of outdoor luminaires such as road luminaires is controlled by limiting the luminous intensity in certain directions. For example, the luminous intensity is limited to remain below a certain level at large emission angles, e.g. emission angles larger than 80 degrees. The emission angle is defined as a vertical angle above the direction pointing directly downward from the outdoor luminaire. Hereinafter, a vertical angle above the direction pointing directly downward from the luminaire is also referred to as vertical angle for short.

With the continuous increase of the luminous efficiency of high power LEDs in recent years, more and more outdoor LED luminaires have been set up for road or urban lighting.

A typical LED luminaire for road lighting is depicted in FIG. 1. The appearance of the LED luminaire 100 differs substantially from a traditional luminaire for road lighting such as the popular HID luminaire. The traditional luminaire generally has a curved cover plate, because, firstly, its light source is large in size and the curved cover plate can provide sufficient space for disposing the light source, and secondly, its light source generates a large amount of heat and the cover plate should be kept at a certain distance from the light source to avoid overheating. Contrary thereto, LED light source 110 is small in size, so that less space is required, and the heat generated by the light source is mostly dissipated from the back of the light source. Hence, a curved cover plate is unnecessary for the LED luminaire. Accordingly, a flat cover plate 120 is used for the LED luminaire because the flat cover plate is easier to manufacture and costs less than the curved cover plate. Moreover, the flat cover plate 120 is also advantageous in limiting luminous intensity at large emission angles.

As mentioned above, the LED luminaire has a higher luminous efficiency than the traditional luminaire. However, as regards outdoor LED luminaires, such as LED luminaires for road or urban lighting, there are more complaints from end users, including vehicle drivers and pedestrians, that they cause glare.

SUMMARY OF THE INVENTION

The present invention is an improvement over the existing outdoor LED luminaire.

It would be advantageous to provide an outdoor LED luminaire capable of effectively reducing or eliminating said glare.

Glare is normally defined as disability glare and discomfort glare. Disability glare has been fairly well defined based on the physiology of the human eye and the behavior of light as it enters the ocular media; discomfort glare is defined as a glare source which causes the observer to feel uncomfortable. The technology committee of CIE.TC3-4 has reported that if the problem of discomfort glare is solved, disability glare is no longer a problem. In other words, disability glare can be controlled well if discomfort glare from the luminaries is controlled efficiently.

Hence, it would be also advantageous to provide an outdoor LED luminaire capable of effectively reducing or eliminating the negative discomfort glare.

The inventors of the present invention have recognized that, for outdoor LED luminaires, limiting the luminous intensity at large emission angles strengthens the end users' perception of glare. As an end user gradually approaches an outdoor LED luminaire, firstly he perceives almost no brightness, because he only sees the light at large emission angles, and the luminous intensity at large emission angles is greatly limited, and then the perceived brightness is high when he is near enough to the outdoor LED luminaire, because the luminous intensity at small emission angles is high. Such a large difference in luminous intensity between large emission angles and small emission angles enhances the end user's perception of brightness at small emission angles. Moreover, the relatively small emission surface of the LED light source further increases the brightness of the LED light source towards the end users and hence the perception of glare.

Accordingly, it is proposed in the present invention to solve the discomfort glare problem by increasing the adaptation level of end users.

To better address one or more of these concerns, there is provided an outdoor luminaire, which comprises:

a light module comprising at least one LED unit;

wherein said light module is configured such that the light emitted from the light module has a first luminous intensity value no less than 10 cd/klm at a first angle $\gamma 1$, which is a vertical angle of 90 degrees above a direction pointing directly downward from the luminaire.

In this way, the luminous intensity of the outdoor luminaire at a vertical angle of 90 degrees is guaranteed to be not less than 10 cd/klm. Since the end user sees the light emitted at a vertical angle of 90 degrees no matter how far away he is from the outdoor luminaire, the end user always perceives a certain level of brightness. Such certain level of brightness is helpful in increasing the adaptation level of the end user, and can effectively reduce the end user's perception of glare when he is near the outdoor luminaire and sees the relatively strong light emitted at smaller vertical angles (i.e. at smaller emission angles).

Preferably, the first luminous intensity value is not less than 20 cd/klm. Generally speaking, as long as the first luminous value is not so high to cause a perception of glare, the larger the first luminous intensity value, the smaller the difference in brightness will be for an end user at different distances from the outdoor luminaire, and hence the better the adaptation level of the end user will be.

According to an embodiment of the present invention, the light emitted from the light module has a second luminous intensity value no less than 40 cd/klm at a second angle $\gamma 2$, which is a vertical angle of 80 degrees above the direction pointing directly downward from the luminaire.

Additionally, according to an embodiment of the present invention, the light emitted from the light module has a third luminous intensity value at a third angle $\gamma 3$, which is a vertical angle of less than 80 degrees above the direction pointing directly downward from the luminaire; said third luminous intensity value is no less than the second luminous intensity value; said second luminous intensity value is no less than the first luminous intensity value.

As the end user gradually approaches the outdoor luminaire, the vertical angle of the light which he sees also decreases. That is, he may initially only see the light emitted at the first vertical angle γ1 of 90 degrees, then he sees the light emitted at the second vertical angle γ2 of 80 degrees, and then he sees the light emitted at the third angle γ3 of less than 80 degrees. In this way, the adaptation level of the user is further increased and the end user's perception of glare caused by light emitted at small vertical angles can be further reduced.

According to an embodiment of the present invention, each of the first and the second luminous intensity value is not greater than 100 cd/klm.

In this way, the brightness of the light emitted at large vertical angels including 80 degrees and 90 degrees is limited so as not to be a source of glare.

The light emitted at large vertical angels such as 80 degrees or 90 degrees can be obtained in many different ways.

According to an embodiment of the present invention, the light module comprises a first LED light unit; said light module further comprises a first optical element disposed in front of said first LED light unit; and said first optical element is configured to transform part of the light from said first LED light unit over a first range of angles, from said second vertical angle γ2 to said first vertical angle γ1.

Said first optical element can comprise a curved cover plate, which is made of transparent material.

The transparent material diffuses a relatively small amount of light incident on it. When the first LED light unit emits no light or insufficient light over said first range of angles, the curvature of the plate can transform part of the light emitted at small vertical angels (i.e. vertical angles smaller than γ2) over said first range of angles. Moreover, different transparent material diffuses a different amount of light. Thus, by choosing proper transparent material, a desired amount of light can be transformed.

Alternatively, said first optical element can comprise a curved wire grid, which is made of diffusing material.

By means of such a curved wire grid, a first part of the light emitted by the first LED unit is diffused by the wire grid made of diffusing material, and a second part of the light emitted by the first LED unit is not influenced by the wire grid because the wire grid does not intersect its propagation path. Generally, the desired luminous intensity at the first and/or second vertical angles is small compared to the overall luminance of the outdoor luminaire. Thus, the majority of the light emitted by the first LED unit will not be influenced by the wire grid, so that it is more convenient to design the light distribution of the light module.

According to another embodiment of the present invention, said light module comprises a first LED light unit and a second light unit; said first LED light unit is configured such that the light emitted from said first LED light unit has a luminous intensity value less than said first luminous intensity value at said first angle γ1, and has a luminous intensity value less than said second luminous intensity value at said second angle γ2; and said second light unit is configured to emit light at least over a second range of angles, from said second angle γ2 to said first angle γ1.

Preferably, said second light unit is a LED light unit.

In an embodiment, said second light unit is disposed on a side surface of said outdoor luminaire.

In another embodiment, said second light unit is disposed above said first LED light unit. In this way, the light emitted from said second light unit reduces the difference in brightness between the dark sky and the outdoor luminaire and therefore further increases the adaptation level of the end users.

According to an embodiment, said second light unit comprises at least one of a light array and a light band.

BRIEF DESCRIPTION OF THE DRAWINGS

Other features, purposes and advantages of the present invention will become more apparent from the following detailed description of non-limiting exemplary embodiments taken in conjunction with the accompanying drawings.

Identical or similar reference signs indicate identical or similar devices (modules).

DETAILED DESCRIPTION OF EMBODIMENTS

A detailed description of the present invention is given below in connection with the accompanying drawings.

Figure 1:
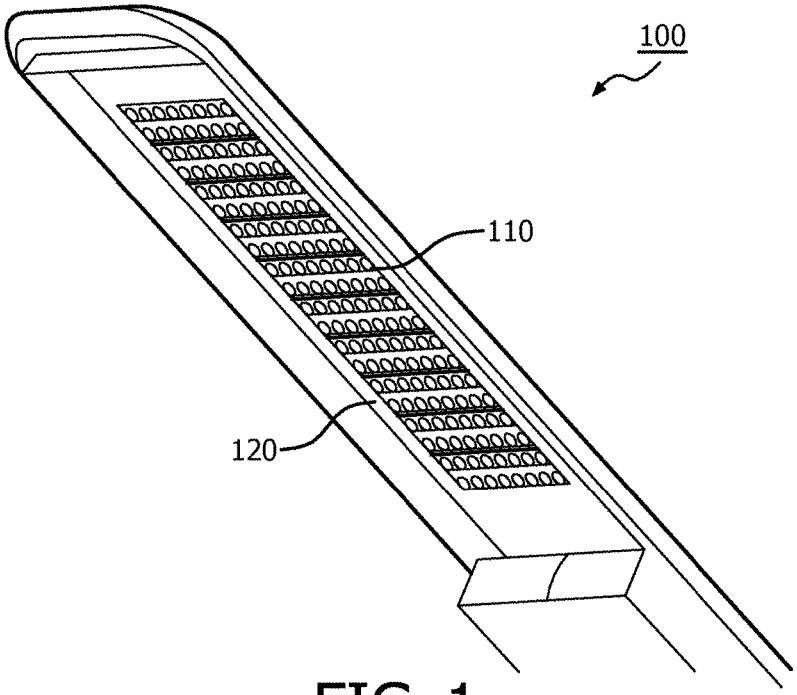
FIG. 1 (Prior art)
FIG. 1 illustrates a diagram for a typical outdoor LED luminaire in accordance with the prior art.
Figure 2:
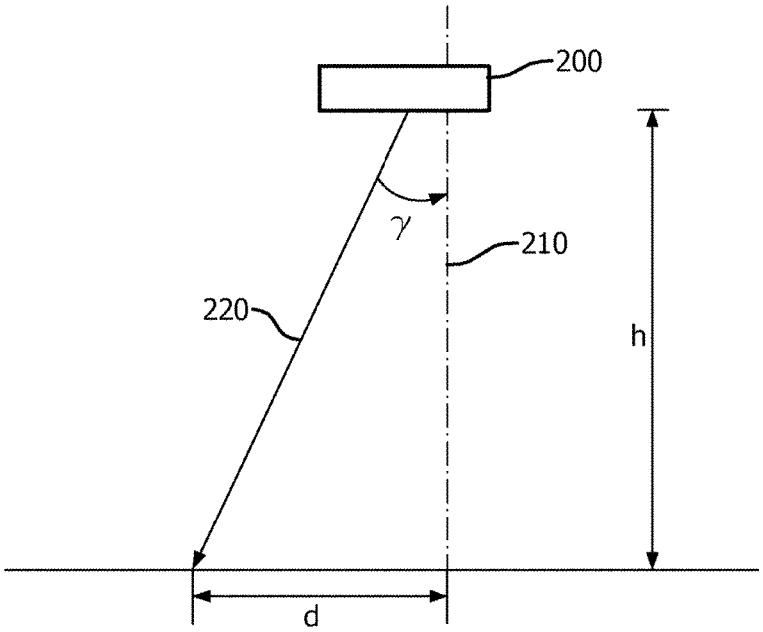
FIG. 2 illustrates a diagram for an outdoor LED luminaire according to an embodiment of the present invention.

FIG. 2 illustrates a diagram for an outdoor LED luminaire according to an embodiment of the present invention.

As is well-known, the lighting quantities of an outdoor luminaire can be described by means of luminous intensity values at various vertical angles above the direction pointing directly downward from the luminaire. The luminous intensity is normally expressed in candelas per kilolumen (cd/klm) from all light sources in the luminaire. The direction pointing directly downward from the luminaire is also known as the first axis of the luminaire, and the vertical angle above the direction pointing directly downward from the luminaire is also known as vertical photometric angle (of a light path), which is defined as the angle between the light path and the first axis of the luminaire.

Referring to FIG. 2, the direction pointing directly downward from the luminaire 200 is depicted as axis 210, and the vertical angle of the light emitted by the luminaire 200 along light path 220 is depicted as angle y.

According to an embodiment of the present invention, the luminaire 200 comprises a light module comprising at least one LED unit. The light module is configured such that the light emitted from the light module has a first luminous intensity value not less than 10 cd/klm at a first angle γ1, which is a vertical angle of 90 degrees above a direction pointing directly downward from the luminaire. In another embodiment, the first luminous intensity value can be not less than 20 cd/klm.

Additionally, the light emitted from the light module has a second luminous intensity value no less than 40 cd/klm at a second angle γ2, which is a vertical angle of 80 degrees above the direction pointing directly downward from the luminaire.

Further referring to FIG. 2, the light emitted from the luminaire 200 along the light path 220 illuminates the space extending over a distance d from the luminaire at a given height h, and the smaller the vertical angle γ, the smaller the distance d is.

According to an embodiment of the present invention, the luminous intensity values at smaller vertical angles are set to be relatively large so as to sufficiently illuminate the space around the outdoor luminaire, and the luminous intensity values at larger vertical angles are set to be relatively small so as to avoid causing glare.

In an example, the light module of the outdoor luminaire 200 has a third luminous intensity value at a third angle γ3, which is a vertical angle of less than 80 degrees above the direction pointing directly downward from the luminaire. The third luminous intensity value is no less than the second luminous intensity value, and the second luminous intensity value is no less than the first luminous intensity value. For example, the luminous intensity values at various vertical angles can increase with the decrease of the vertical angles.

In another example, each of the first and the second luminous intensity value is not greater than 100 cd/klm.

Figure 3:
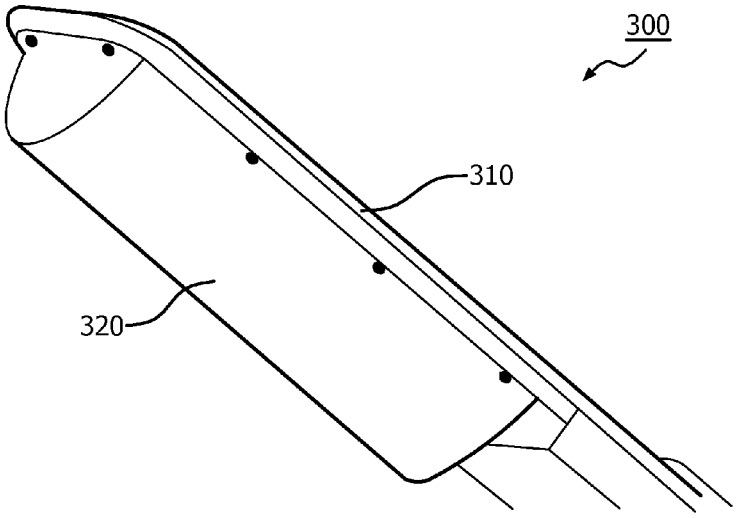
FIG. 3 illustrates a diagram for an outdoor LED luminaire comprising a curved cover plate according to an embodiment of the present invention.

FIG. 3 illustrates a diagram for an outdoor LED luminaire comprising a curved cover plate according to an embodiment of the present invention.

Referring to FIG. 3, the outdoor luminaire 300 comprises a housing 310, and a first LED light unit disposed inside the housing 310. The outdoor luminaire 300 further comprises a curved cover plate 320, which is made of transparent material. The curved cover plate 320 is disposed in front of the first LED light unit.

The first LED light unit is configured to emit no light or insufficient light over a first range of vertical angles from 80 degrees to 90 degrees, e.g. with an intensity value less than the first luminous intensity value at a vertical angle of 90 degrees and/or with an intensity less than the second luminous intensity value at a vertical angle of 80 degrees.

The curvature of the plate transforms part of the light emitted at small vertical angels (i.e. vertical angles less than 80 degrees) over the first range of vertical angles such that the light emitted from the outdoor luminaire 200 has desired luminous intensity values over the first range of vertical angles. For example, the desired luminous intensity values include the first luminous intensity value at the vertical angle of 90 degrees and the second luminous intensity value at the vertical angle of 80 degrees.

Different transparent material diffuses a different amount of light. Thus, by choosing proper transparent material, a desired amount of light can be transformed.

Figure 4:
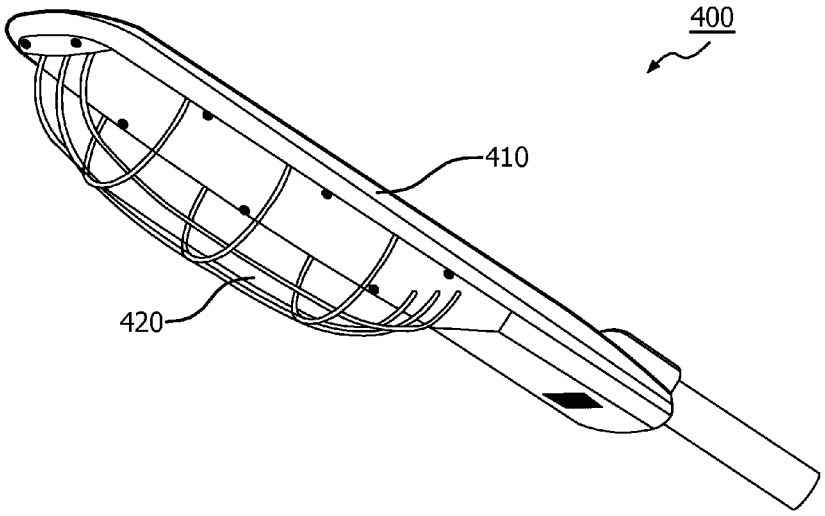
FIG. 4 illustrates a diagram for an outdoor LED luminaire comprising a curved wired grid according to another embodiment of the present invention.

FIG. 4 illustrates a diagram for an outdoor LED luminaire comprising a curved wire grid according to another embodiment of the present invention.

Referring to FIG. 4, the outdoor luminaire 400 is similar to the outdoor luminaire 300 of FIG. 3, and the difference resides in that the curved cover plate 320 is replaced by a curved wire grid 420. The curved wire grid 420 is made of diffusing material and can at least diffuse most of the incident light. Thus, similar to the curved cover plate 320, the curved wire grid 420 can transform part of the light emitted by the first LED unit over the first range of vertical angles, which is from 80 degrees to 90 degrees.

Figure 5:
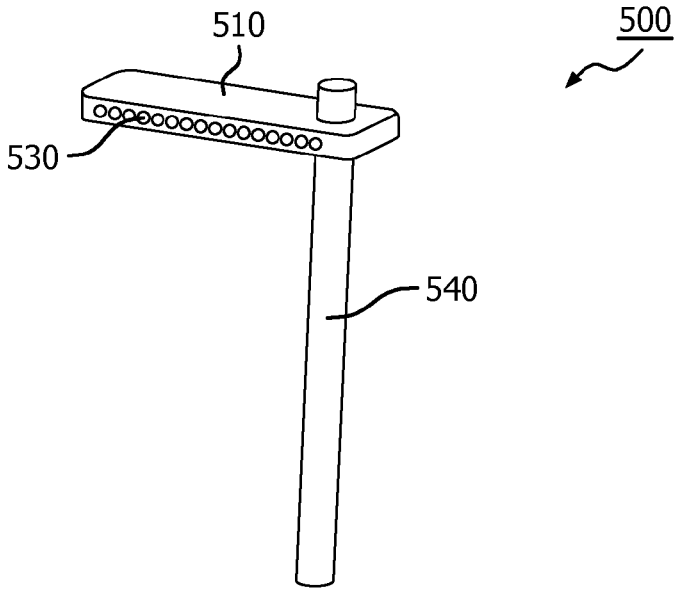
FIG. 5 illustrates a diagram for an outdoor LED luminaire comprising a light array on the side according to another embodiment of the present invention.

FIG. 5 illustrates a diagram for an outdoor LED luminaire comprising a light array on the side according to another embodiment of the present invention.

Referring to FIG. 5, the outdoor luminaire 500 comprises a light module and a pole 540 on which the light module is installed. The light module of the outdoor luminaire 500 comprises a housing 510 and a first LED light unit disposed inside the housing 510. The light module further comprises a second light unit 530 disposed on the side of housing 410. Preferably, the second light unit 530 is also a LED light unit.

In order to achieve that the light emitted from the light module has a first luminous intensity value at a first angle γ1, i.e. a vertical angle of 90 degrees, and a second luminous intensity value at a second angle γ2, i.e. a vertical angle of 80 degrees, the first LED light unit and the second light unit can be configured as follows: the first LED light unit is configured such that the light emitted from said first LED light unit has a luminous intensity value less than the first luminous intensity value at said first angle γ1, and has a luminous intensity value less than the second luminous intensity value at said second angle γ2. Moreover, the second light unit is configured to emit light at least over a second range of angles from said first angle γ2 to first angle γ1.

Figure 6:
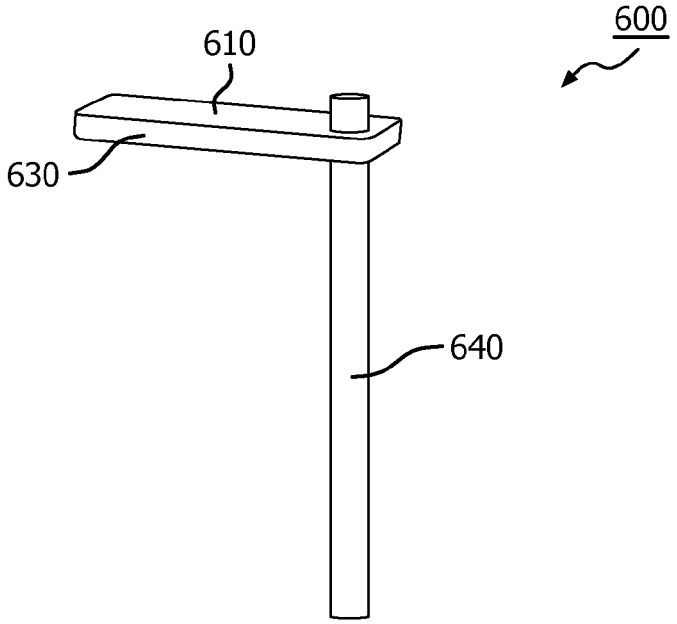
FIG. 6 illustrates a diagram for an outdoor LED luminaire comprising a light panel on the side according to another embodiment of the present invention.

As shown in FIG. 5, the second light unit 530 can be a light array. Alternatively, the second light unit 530 can be a light panel 630, as shown in FIG. 6.

Figure 7:
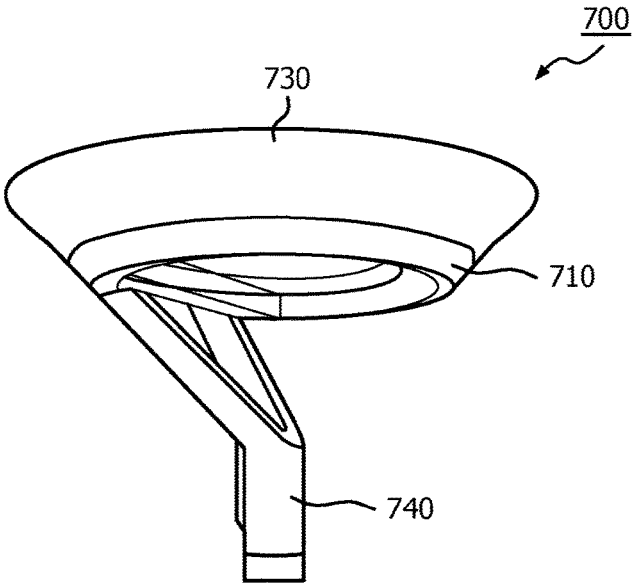
FIG. 7 illustrates a diagram for an outdoor LED luminaire comprising a light panel at the top according to another embodiment of the present invention.

FIG. 7 illustrates a diagram for an outdoor LED luminaire comprising a light panel at the top according to another embodiment of the present invention.

Similar to the outdoor luminaire 500 of FIG. 5, the outdoor luminaire 700 comprises a light module and a pole 740 on which the light module is installed; the light module of the outdoor luminaire 700 comprises a housing 710 and a first LED light unit disposed inside the housing 710; the light module further comprises a second light unit 730.

Unlike the outdoor luminaire 500 of FIG. 5, the second light unit 730 is disposed at the top of housing 710.

Similarly to the second light unit 530 of the outdoor luminaire 500, the second light unit 730 of the outdoor luminaire 700 can emit light at least over a second range of angles, which is from said second angle γ2 to first angle γ1.

As shown in FIG. 7, the second light unit 730 can be a light panel. Alternatively, the second light unit 730 can be a light array or the like.

A person skilled in the art realizes that the present invention by no means is limited to the preferred embodiments described above. On the contrary, many modifications and variations are possible within the scope of the appended claims. It should be noted that the above-mentioned embodiments illustrate rather than limit the invention and that those skilled in the art will be able to design alternative embodiments without departing from the scope of the appended claims. In the claims, any reference signs placed between parentheses shall not be constructed as limiting the claim. The word "comprising" does not exclude the presence of elements or steps not listed in a claim. The word "a" or "an" preceding an element does not exclude the presence of a plurality of such elements. The usage of the words first, second and third, etc., does not indicate any ordering. These words are to be interpreted as names. No specific sequence of acts is intended to be required unless specifically indicated.

The invention claimed is:

1. An outdoor luminaire comprising:

a light module comprising:

a housing;

a first LED light unit disposed inside the housing;

a second LED light unit disposed exterior to the housing;

wherein said light module is configured such that the light emitted from the light module has a first luminous intensity value no less than 10 cd/klm at a first angle (γ1), which is a vertical angle of 90 degrees above a direction pointing directly downward from the luminaire;

wherein the first LED light unit is configured to emit light in a downward direction and the second LED light unit is configured to emit light in perpendicular direction to the downward direction, to enable the first luminous intensity value and a second luminous intensity at a second angle (γ2); and, wherein the second luminous intensity has a value no less than 40 cd/klm at the second angle (γ2), which is a vertical angle of 80 degrees above the direction pointing directly downward from the luminaire.

2. The outdoor luminaire according to claim 1, wherein the light emitted from the light module has a third luminous intensity value at a third angle (γ3), which is a vertical angle of less than 80 degrees above the direction pointing directly downward from the luminaire;

said third luminous intensity value is no less than the second luminous intensity value;

said second luminous intensity value is no less than the first luminous intensity value.

3. The outdoor luminaire according to claim 1, wherein each of the first and the second luminous intensity value is no greater than 100 cd/klm.

4. The outdoor luminaire according to claim 1, wherein said light module further comprises a first optical element disposed in front of said first LED light unit; and said first optical element is configured to transform part of the light from said first LED light unit over a first range of angles, which range is from said second angle (γ2) to said first angle (γ1).

5. The outdoor luminaire as claimed in claim 4, wherein said first optical element comprises a curved cover plate, which is made of transparent diffusing material.

6. The outdoor luminaire as claimed in claim 4, wherein said first optical element comprises a curved wire grid, which is made of diffusing material.

7. The outdoor luminaire as claimed in claim 1, wherein said second LED light unit is disposed on a top surface of the housing.

8. The outdoor luminaire as claimed in claim 1, wherein said second light unit comprises at least one of a light array and a light band.

9. The outdoor luminaire as claimed in claim 1, wherein said second LED light unit is disposed on a side surface of the housing.

* * * * *